US006607284B1

(12) United States Patent
Tsai

(10) Patent No.: US 6,607,284 B1
(45) Date of Patent: Aug. 19, 2003

(54) LIGHTING STRUCTURE USED FOR DECORATING

(75) Inventor: Hung-Chi Tsai, GuangDong (CN)

(73) Assignee: Shenghui Lighting Co., Ltd., Guangdong (CN)

( * ) Notice: Subject to any disclaimer, the term of this patent is extended or adjusted under 35 U.S.C. 154(b) by 0 days.

(21) Appl. No.: 10/244,835

(22) Filed: Sep. 17, 2002

(51) Int. Cl.[7] ..... F21S 13/14

(52) U.S. Cl. ..... 362/121; 362/235; 362/249; 362/806; 362/807; 362/238; 362/250

(58) Field of Search ..... 362/121, 252, 362/807, 249, 235, 287, 418, 419, 285, 427, 250, 238

(56) References Cited

U.S. PATENT DOCUMENTS

| | | | | | |
|---|---|---|---|---|---|
| 3,541,322 | A | * | 11/1970 | Bennett | 362/121 |
| 6,179,442 | B1 | * | 1/2001 | Schurle | 362/252 |
| 6,203,166 | B1 | * | 3/2001 | Byers | 362/121 |
| 6,497,498 | B2 | * | 12/2002 | Adams | 362/252 |
| 6,511,206 | B1 | * | 1/2003 | Fan Wong | 362/250 |

* cited by examiner

*Primary Examiner*—Thomas M. Sember
(74) *Attorney, Agent, or Firm*—Harrison & Egbert

(57) ABSTRACT

A decorative lighting structure includes a plurality of lighting tubes which are pivotally fastened end to end by a plurality of convex joints and concave joints, thereby enabling the lighting tubes to be spread out or folded so as to take various forms.

2 Claims, 8 Drawing Sheets

LIGHTING STRUCTURE USED FOR DECORATING

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a decorative lighting structure, and more particularly to a decorative lighting structure adjustable in form.

BACKGROUND OF THE INVENTION

The conventional decorative lighting structure is generally formed of a series of light bulbs, which are arranged by an electric cord. Such conventional lighting structure is suitable for use in decorating a tree, shrub, or the like; nevertheless it is not appropriate for use in decorating a wall. In addition, the light bulbs of the conventional lighting structure are susceptible to damage, especially at such time when the light structure is being retrieved. Moreover, the conventional lighting structure is so easily intertwined that it cannot be stored in an orderly manner.

BRIEF SUMMARY OF THE INVENTION

It is the primary objective of the present invention to provide a decorative lighting structure which is simple in construction and is versatile in design.

It is another objective of the present invention to provide a decorative lighting structure which is durable and collapsible for easy storage and transportation.

In keeping with the principle of the present invention, the foregoing objectives of the present invention are attained by a lighting structure comprising a plurality of lighting tubes which are joined together end to end by a plurality of movable joints, thereby enabling the lighting tubes to be arranged in various forms.

The features, functions, and advantages of the present invention will be more readily understood upon a thoughtful deliberation of the following detailed description of the present invention with reference to the accompanying drawings.

DETAILED DESCRIPTION OF THE INVENTION

Figure 1:
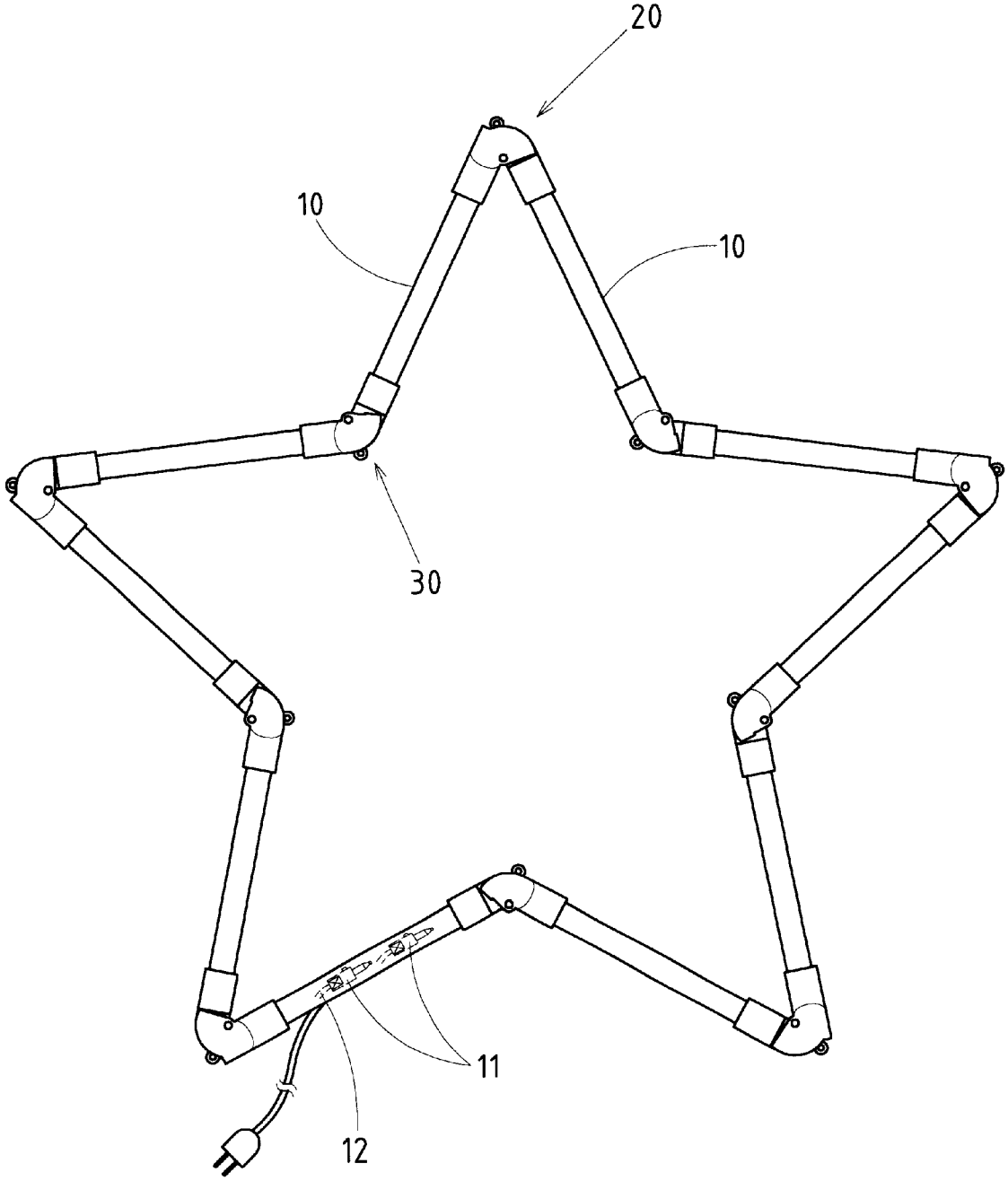
FIG. 1 shows a schematic plan view of the present invention in an unfolded state.

As shown in FIGS. 1–6, a lighting structure of the present invention is used for decorating and comprises a plurality of lighting tubes 10, convex joints 20, and concave joints 30.

The lighting tubes 10 are joined together end to end by the convex joints 20 and the concave joints 30 such that the lighting tubes 10 can be arranged in various forms, thereby enabling the lighting structure of the present invention to take a stellar, cruciform, or snowflake shape. Each of the lighting tubes 10 is provided in the interior with two or more light bulbs 11, which are respectively connected with a bonding wire 12.

Figure 3:
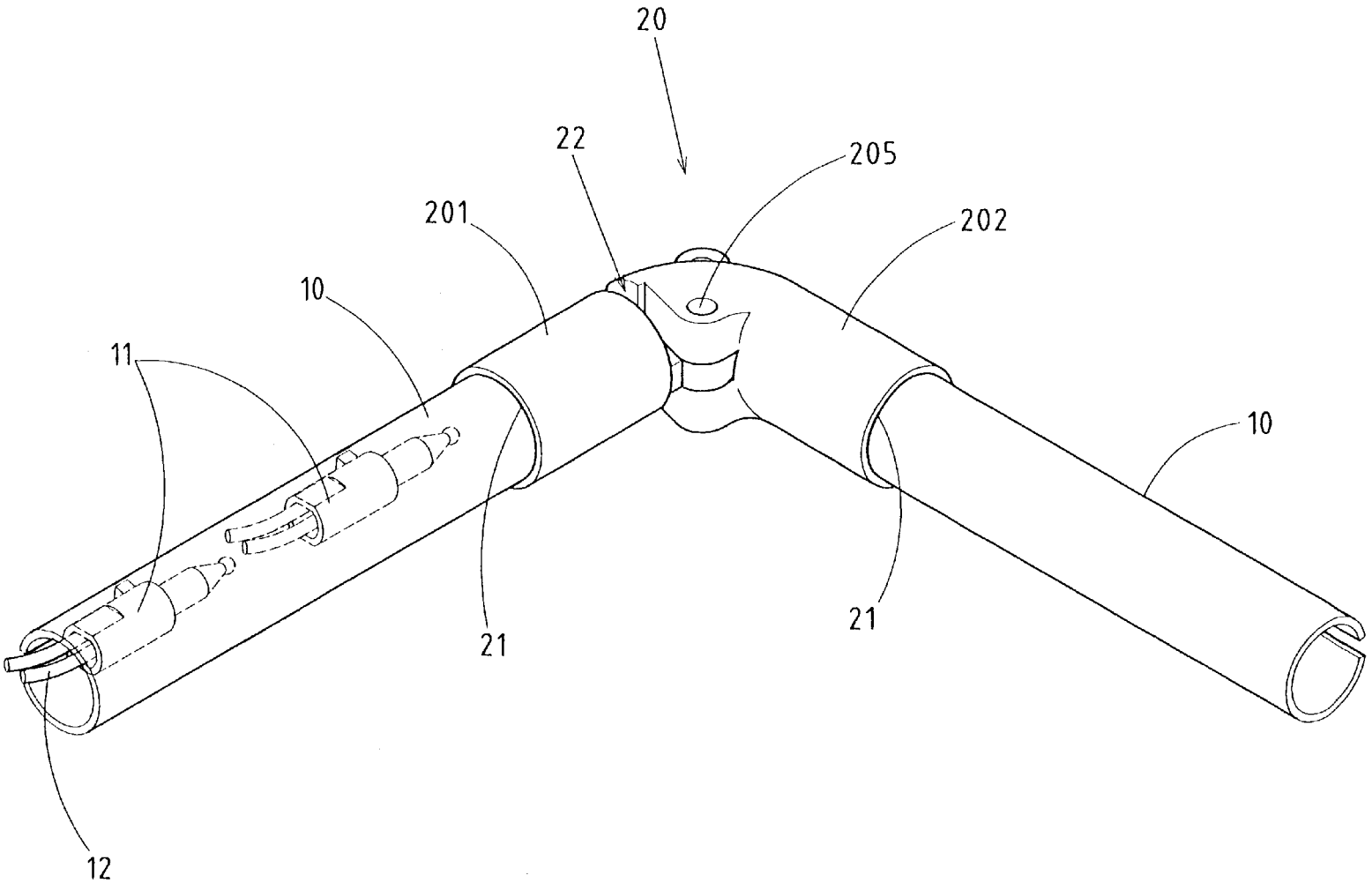
FIG. 3 shows a perspective view of a convex joint of the present invention.
Figure 4:
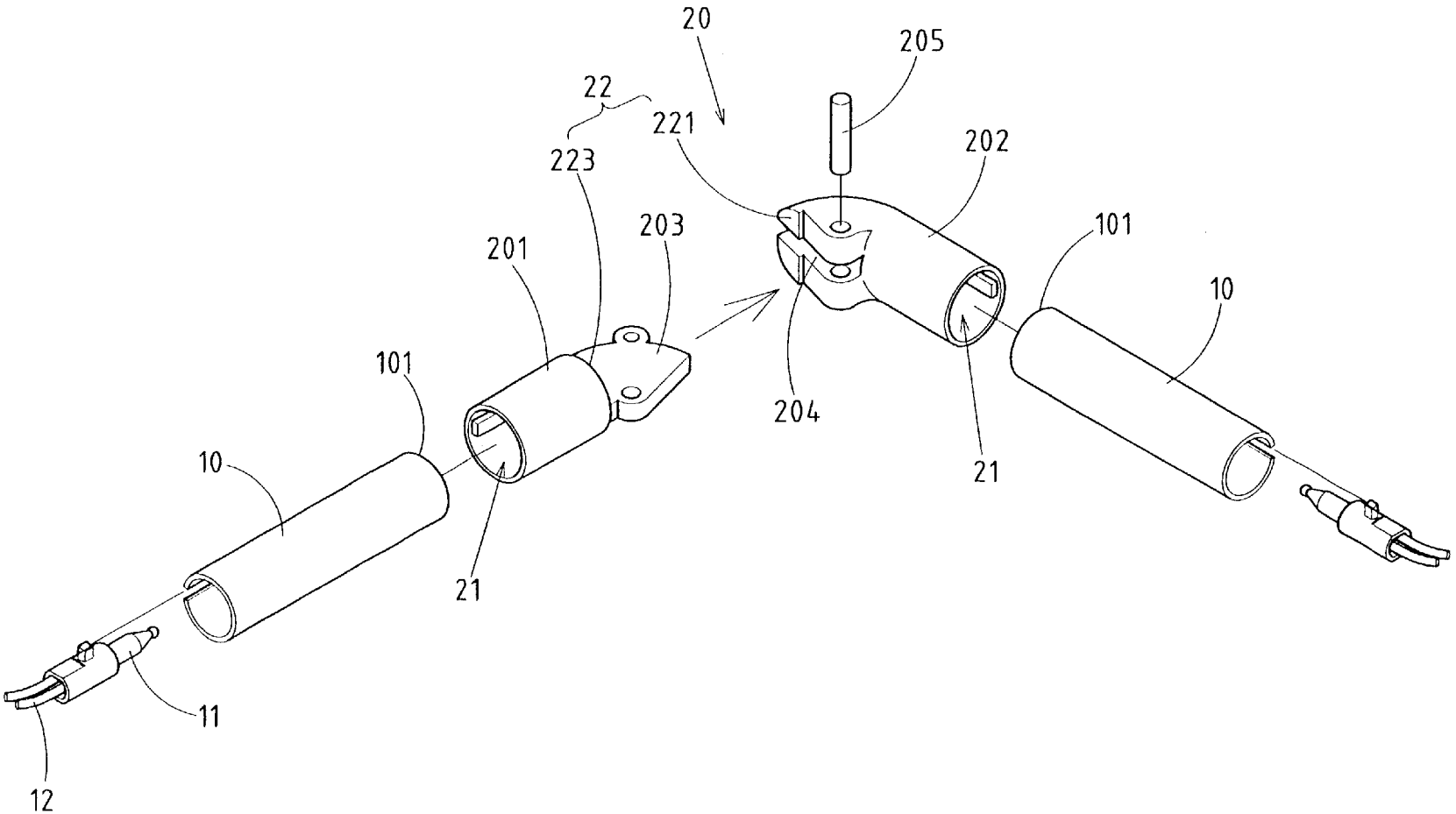
FIG. 4 shows an exploded perspective view of the convex joint as shown in FIG. 3.
Figure 5:
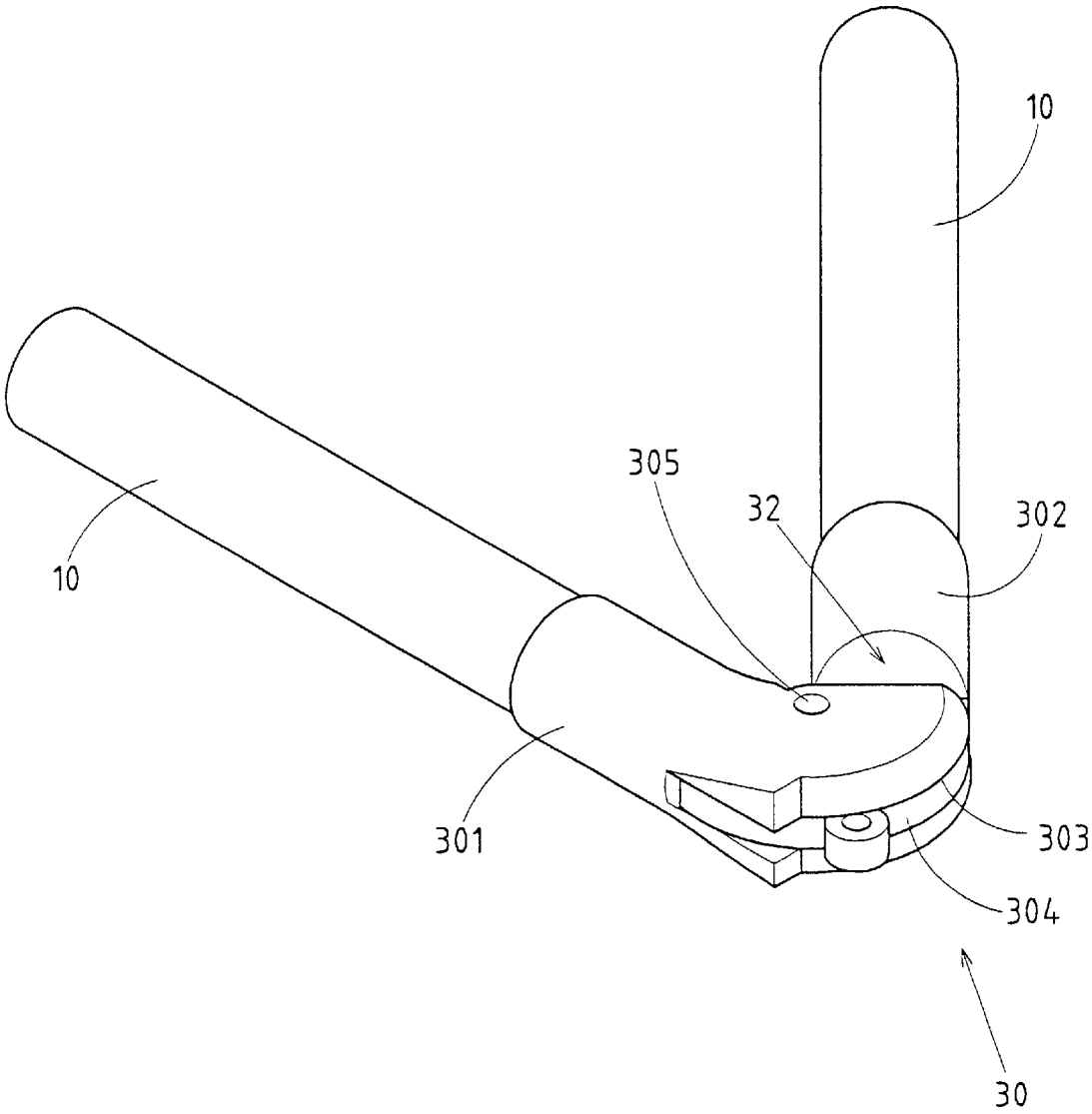
FIG. 5 shows a perspective view of a concave joint of the present invention.

The convex joints 20 are formed of a first tubular member 201 and a second tubular member 202, as shown in FIGS. 3 and 4. Both first tubular member 201 and the second tubular member 202 are provided with a fastening end 21 for fastening a first fastening end 101 of the lighting tubes 10. The first tubular member 201 is provided with a first pivoting end 203 opposite to the fastening end 21 of the first tubular member 201. Similarly, the second tubular member 202 is provided with a second pivoting end 204 opposite to the fastening end 21 of the second tubular member 202. The first pivoting end 203 of the first tubular member 201 is pivoted with the second pivoting end 204 of the second tubular member 202 by a pivot 205.

The convex joints 20 are further provided with a confining member 22, which is formed of a locating face 223 disposed in the first pivoting end 203 of the first tubular member 201, and a locating edge 221 disposed in the second pivoting end 204 of the second tubular member 202. The confining member 22 serves to confine the swiveling of the tubular members 201 and 202.

Figure 6:
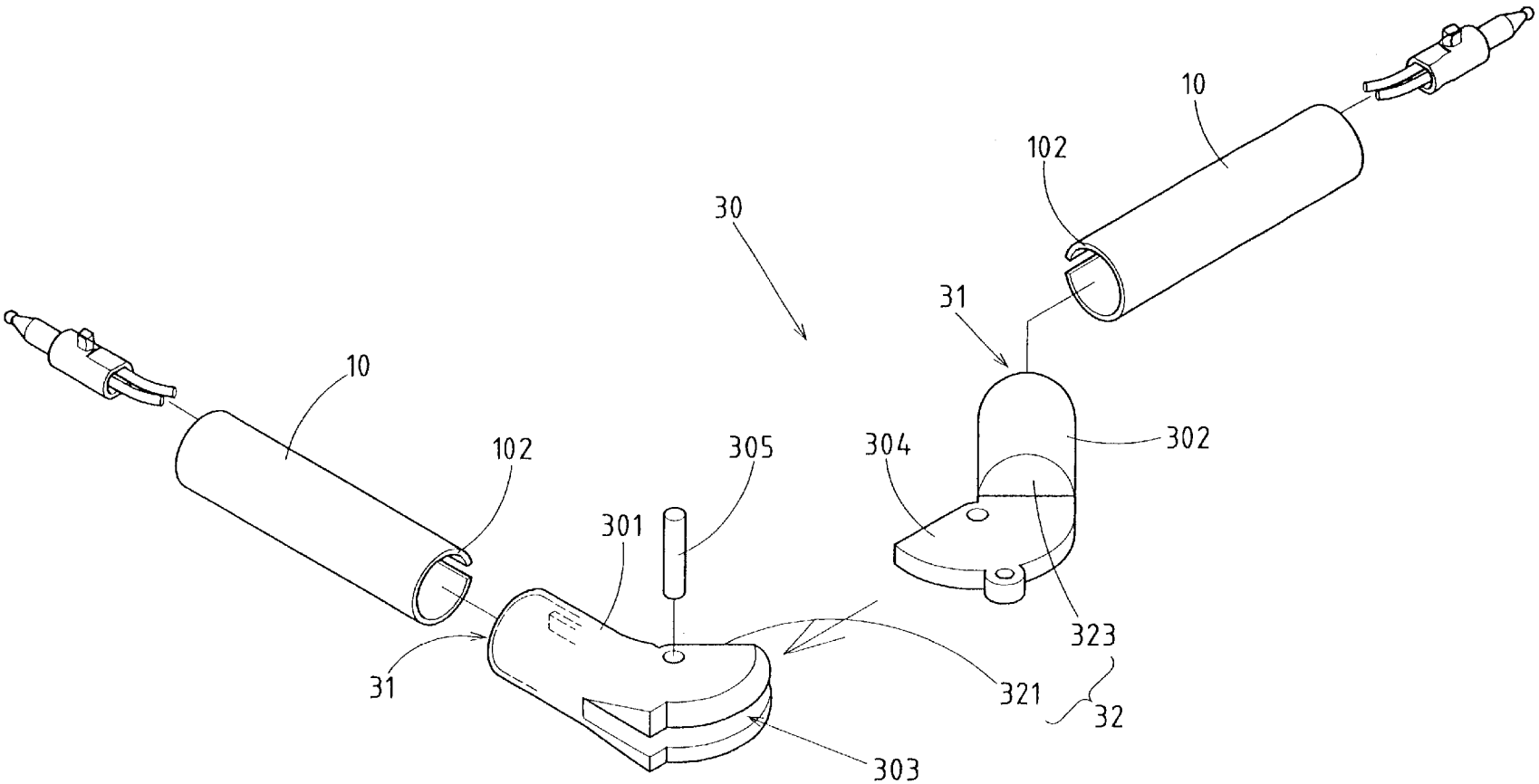
FIG. 6 shows an exploded perspective view of the concave joint as shown in FIG. 5.

The concave joints 30 are formed of a first tubular member 301 and a second tubular member 302, which are respectively provided with a fastening end 31 for fastening a second fastening end 102 of the lighting tubes 10, as shown in FIG. 6. The first tubular member 301 is provided with a first pivoting end 303 opposite to the fastening end 31 of the first tubular member 301, whereas the second tubular member 302 is provided with a second pivoting end 304 opposite to the fastening end 31 of the second tubular member 302. The first pivoting end 303 and the second pivoting end 304 are pivoted together by a pivot 305.

The concave joints 30 are further provided with a confining member 32, which is formed of a locating edge 321 disposed in the first pivoting end 303 of the first tubular member 301, and a locating face 323 disposed in the second pivoting end 304 of the second tubular member 302. The confining member 32 serves to confine the swiveling of the two tubular member 301 and 302.

Figure 2:
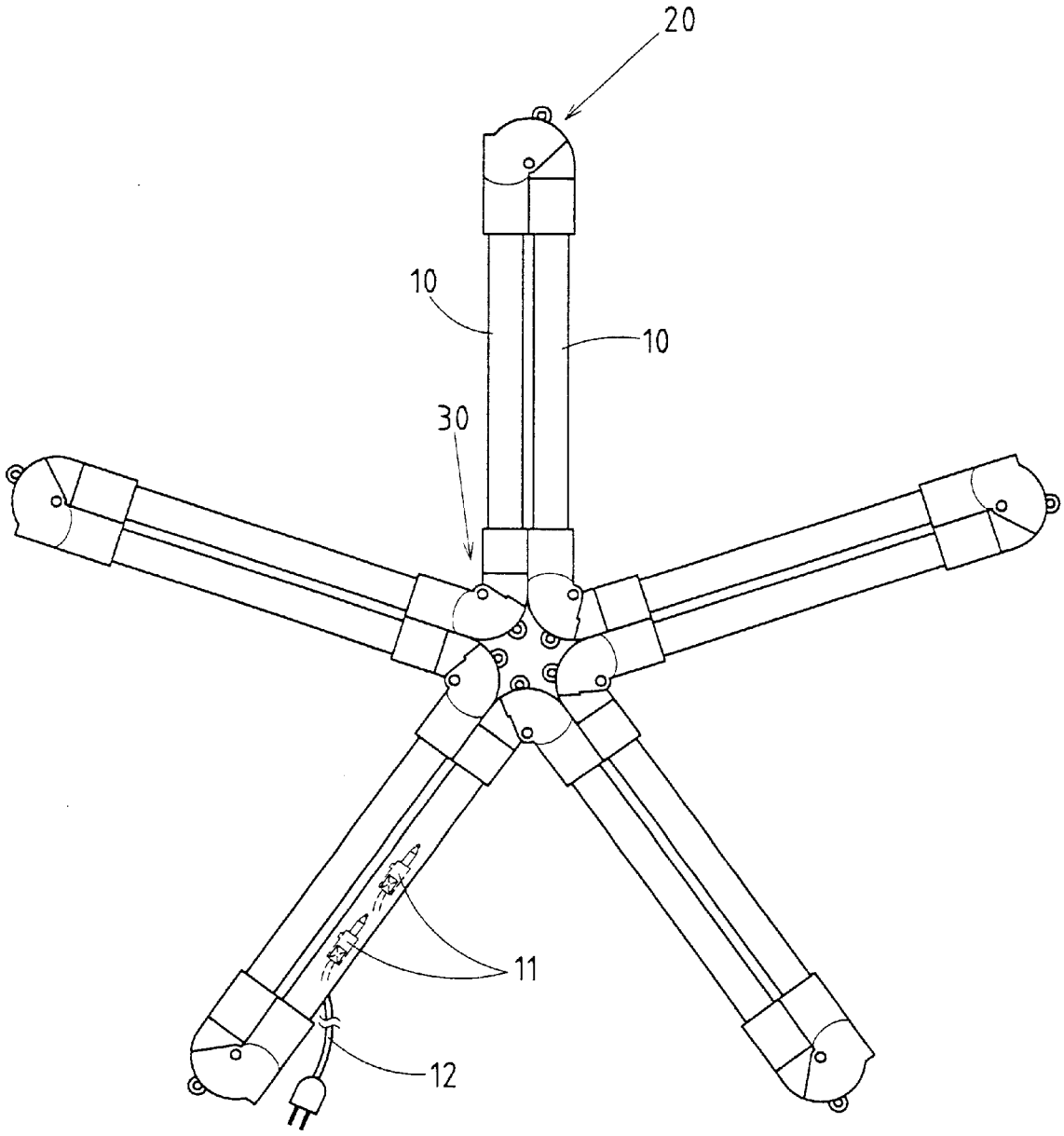
FIG. 2 shows a schematic plan view of the present invention in a folded state.
Figure 7:
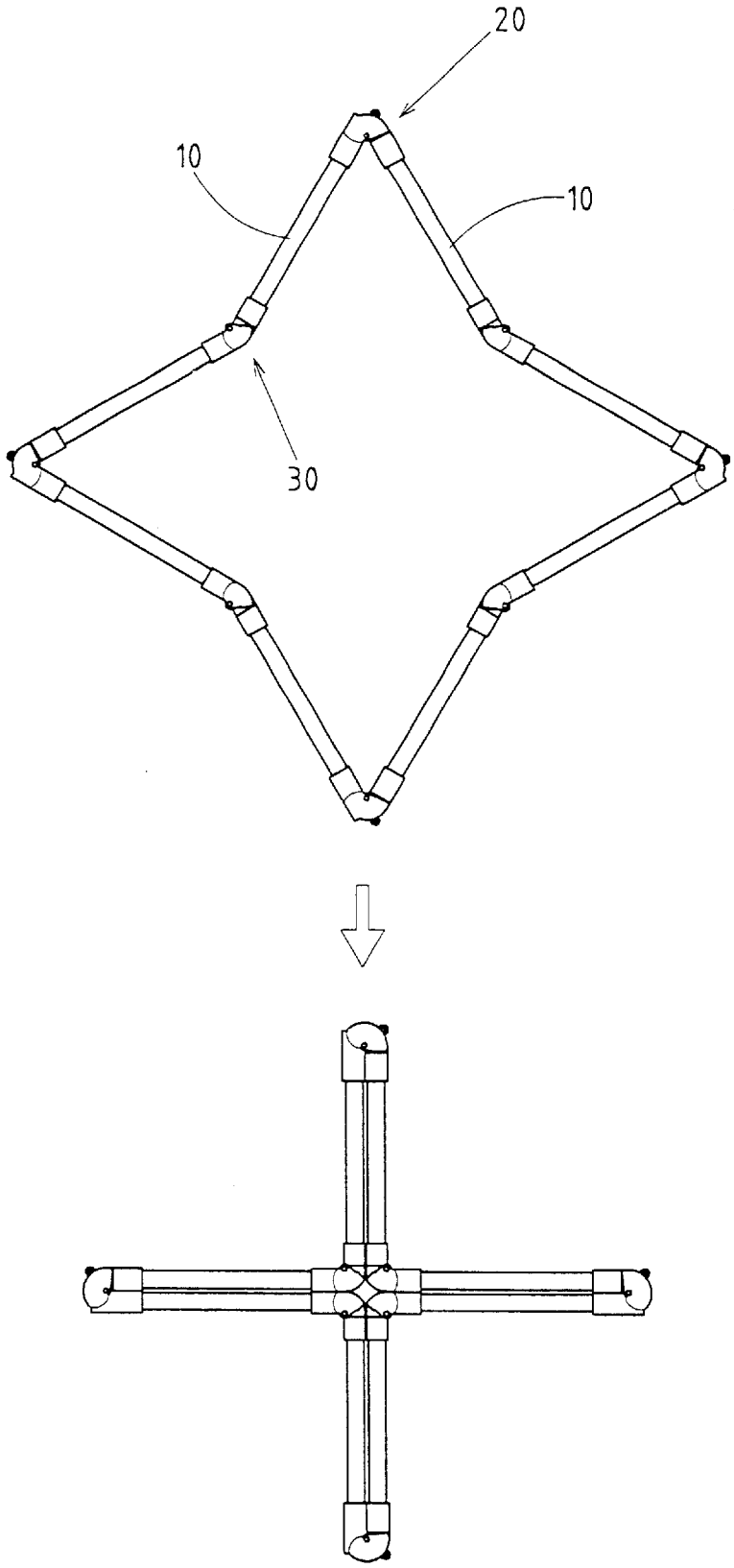
FIG. 7 shows a schematic view of the folding of the present invention.

By virtue of the swiveling actions of the convex joints 20 and the concave joints 30, the lighting tubes 10 can be folded to take a snowflake form, as shown in FIG. 2, or a cruciform shape, as shown in FIG. 7.

Figure 8:
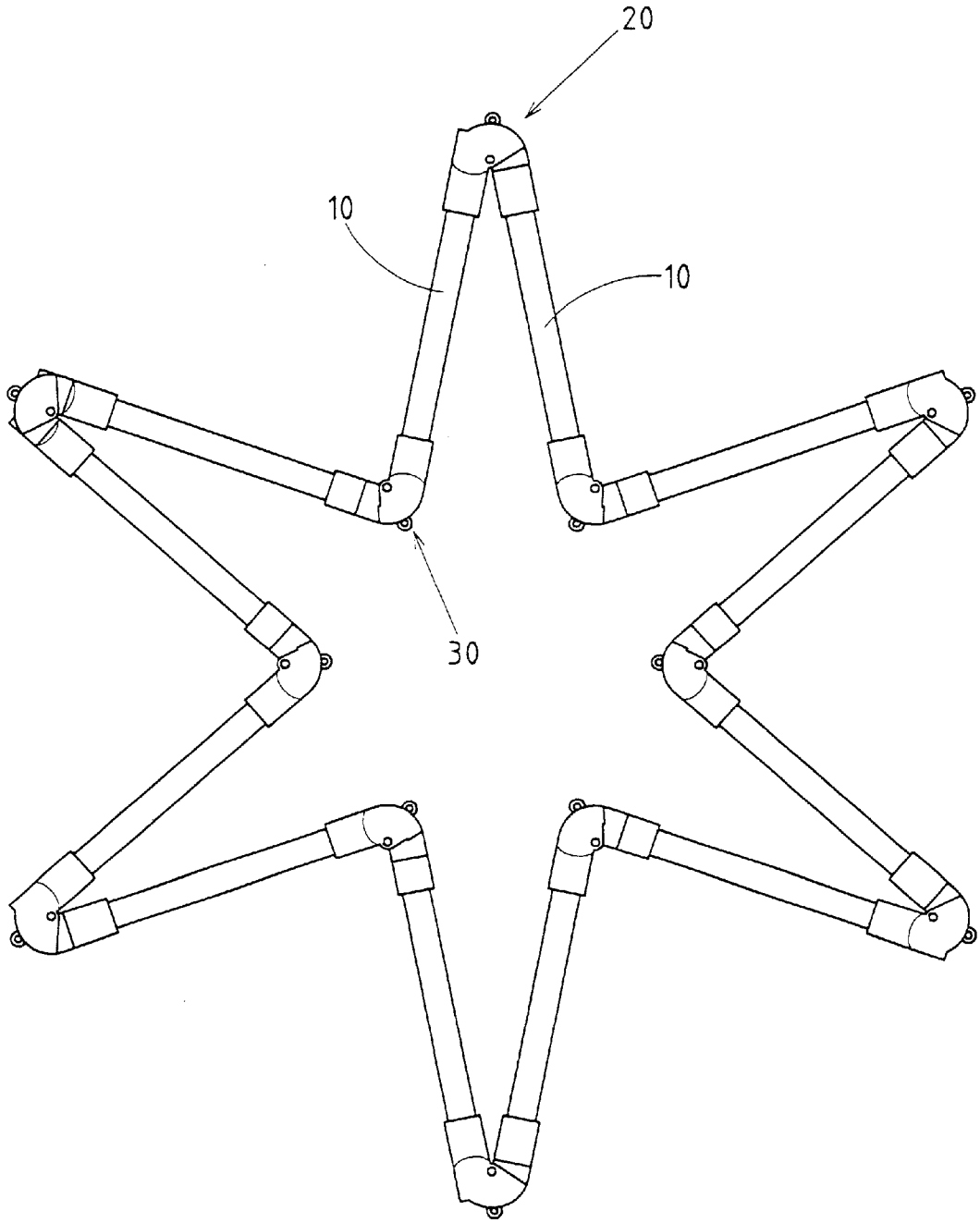
FIG. 8 shows another schematic plan view of the present invention in an unfolded state.

In light of the confining effects of the confining member 22 of the convex joints 20 and the confining member 32 of the concave joints 30, the lighting tubes 10 can be spread out to an extent that they take a stellar form, as shown in FIGS. 1, 7, and 8.

The shape formed by the lighting tubes 10 is dependent on the number of the lighting tubes 10 as well as the confining structures of the confining member 22 of the convex joints 20 and the confining member 32 of the concave joints 30.

The present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A decorative lighting structure comprising:

a plurality of lighting tubes, each tube comprising a first fastening end and a second fastening end, said lighting tubes being provided in an interior with one or more light bulbs;

a plurality of convex joints, each convex joint comprising a first tubular member and a second tubular member, said first tubular member being comprised of a fastening end and a first pivoting end, said second tubular member being comprised of a fastening end and a second pivoting end whereby each of said convex joints is used to fasten pivotally two of said lighting tubes in such a manner that said fastening end of said first tubular member is fastened to said first fastening end of one of the two lighting tubes, and that said fastening end of said second tubular member is fastened to said first fastening end of another one of the two lighting tubes, and that said first pivoting end of said first tubular member and said second pivoting end of said second tubular member are pivoted together by a pivot; and a plurality of concave joints, each concave joint comprising a first tubular member and a second tubular member, said first tubular member being comprised of a fastening end and a first pivoting end, said second tubular member being comprised of a fastening end and a second pivoting end whereby each of said concave joints is used to fasten pivotally the two lighting tubes such that said fastening end of said first tubular member is fastened to said second fastening end of the one of the two lighting tubes, and that said fastening end of said second tubular member is fastened to said second fastening end of the other one of the two lighting tubes, and that said first pivoting end of said first tubular member and said second pivoting end of said second tubular member are pivoted together by a pivot.

2. The decorative lighting structure as defined in claim 1, wherein said first pivoting end of said first tubular member and said second pivoting end of said second tubular member of said convex joints are comprised of a confining structure for confining swiveling of said first tubular member and said second tubular member of said convex joints; wherein said first pivoting end of said first tubular member and said second pivoting end of said second tubular member of said concave joints are comprised of a confining structure for confining swiveling of said first tubular member and said second tubular member of said concave joints.

* * * * *